US006758694B2

(12) United States Patent
Liu

(10) Patent No.: US 6,758,694 B2
(45) Date of Patent: Jul. 6, 2004

(54) CABLE END CONNECTOR ASSEMBLY WITH RELIABLE CONNECTION BETWEEN COVER AND HOUSING

(75) Inventor: Huang Hsin Liu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 19 days.

(21) Appl. No.: 10/313,144

(22) Filed: Dec. 6, 2002

(65) Prior Publication Data

US 2004/0097133 A1 May 20, 2004

(30) Foreign Application Priority Data

Nov. 15, 2002 (TW) ..... 91218335 U

(51) Int. Cl.[7] ..... H01R 13/58
(52) U.S. Cl. ..... 439/606
(58) Field of Search ..... 439/606, 873; 29/883, 856, 858, DIG. 29

(56) References Cited

U.S. PATENT DOCUMENTS 4,585,292 A * 4/1986 Frantz et al. ..... 439/610
4,602,831 A * 7/1986 Lockard ..... 439/108
5,217,396 A * 6/1993 Castanga et al. ..... 439/751
5,580,268 A * 12/1996 Miyazawa ..... 439/352
6,203,376 B1 * 3/2001 Magajne et al. ..... 439/610

FOREIGN PATENT DOCUMENTS

TW 502893 9/2002

* cited by examiner

*Primary Examiner*—Ross Gushi
(74) *Attorney, Agent, or Firm*—Wei Te Chung

(57) ABSTRACT

A cable end connector assembly (1) includes a dielectric housing (10), a plurality of contacts (20) received in the housing, a cable (40), and a cover (50). The housing comprises a front portion (11) and a rear portion (19) extending rearwardly from the front portion. A hole (191) is defined in one wall (192, 193, 194) of the rear portion. Each contact comprises a mating portion (21) and a tail portion (23) opposite to the mating portion. The cable comprises a plurality of conductive cores (41) electrically connecting the tail portions of the contacts, respectively. The cover is over-molded with the rear portion of the housing and a front end of the cable. A projection (54) is formed on an inner surface of one wall (51, 52, 55) of the cover and received in the hole of the housing for enhancing a retaining force between the cover and the housing.

14 Claims, 5 Drawing Sheets

CABLE END CONNECTOR ASSEMBLY WITH RELIABLE CONNECTION BETWEEN COVER AND HOUSING

CROSS-REFERENCE TO RELATED APPLICATION

This patent application is a co-pending application of U.S. patent application entitled "CABLE END CONNECOTR ASSEMBLY WITH RELIABLE CONNECTION BETWEEN CABLE AND COVER" invented by Huang-Hsin Liu, and assigned to the same assignee as this patent application.

BACKGROUND OF THE INVENTION

1. Field of the Invention

The present invention generally relates to a cable end connector assembly, and more particularly to a Serial ATA cable end connector assembly with improved reliable engaging connection between a dielectric housing and a cover.

2. Description of Related Art

There exists in the art an electrical connector assembly known as a Serial Advanced Technology Attachment (Serial ATA) cable end connector assembly which is generally used for transmitting high-speed signals between disk drives and a mother board. Because of many advantages superior to Parallel ATA, Serial ATA has a possibility of replacing Parallel ATA and becomes the next transmitting generation.

Please refer to FIG. 5, a Serial ATA cable end connector assembly 2 generally comprises a dielectric housing 60, a plurality of contact 70 assembled in the dielectric housing 60 with tail portions exposed beyond the dielectric housing 60, a cable 80 electrically connecting with the contacts 70, and a cover 90 over-molded with a rear portion of the dielectric housing 60 and a front end of the cable 80. A pair of projections 61 is formed on the rear portion of the dielectric housing 60 for providing a retaining force between the housing 60 and the cover 90. The cable 80 comprises a plurality of conductive wires 81 electrically connecting with the contacts 70, respectively and an outer insulating jacket 82 enclosing the conductive wires 81 therein. The cover 90 forms a strain relief between the housing 60 and the cable 80. The cover 90 also protects the electrical connection between the contacts 70 and the conductive wires 81 of the cable 80. However, the cover 90 engages with the housing 60 only by friction. In addition, the height that each projection 61 protrudes from corresponding surface of the housing 60 is limited by the specified dimension and the receiving space of the mother board. If the cable end connector assembly 2 is separated from a complementary electrical connector, the cover 90 is inevitably pulled or dragged to some extend. Thus, the cover 90 is easy to break of from the housing 60.

Hence, a cable end connector assembly with reliably engaged dielectric housing and a cover is required to overcome the disadvantages of related art.

SUMMARY OF THE INVENTION an object of the present invention is to provided a cable end connector assembly, which has an improved reliable engaging connection between a dielectric housing and a cover.

In order to achieve the objects set forth, a cable end connector assembly in accordance with the present invention comprises a dielectric housing, a plurality of contacts, a cable, and a cover. The housing comprises a front portion and a rear portion extending rearwardly from the from portion. A plurality of passageways is defined in the front portion of the housing in a front-to-rear direction. A first engaging portion is on one wall of the rear portion. The contacts are received in the passageways, respectively. Each contact comprises a mating portion adapted for electrically connecting the complementary connector and a tail portion opposite to the mating portion. The cable comprises a plurality of conductive cores electrically connecting the tail portions of the contacts, respectively. The cover is over-molded with the rear portion of the housing and a front end of the cable for protecting the electrical connection between the conductive cores and the contacts. A second engaging portion is on an inner surface of one wall of the cover and engaged with the first engaging portion of the housing for enhancing a retaining force between the cover and the housing.

Other objects, advantages and novel features of the invention will become more apparent from the following detailed description when taken in conjunction with the accompanying drawings.

DETAILED DESCRIPTION OF THE INVENTION

Figure 1:
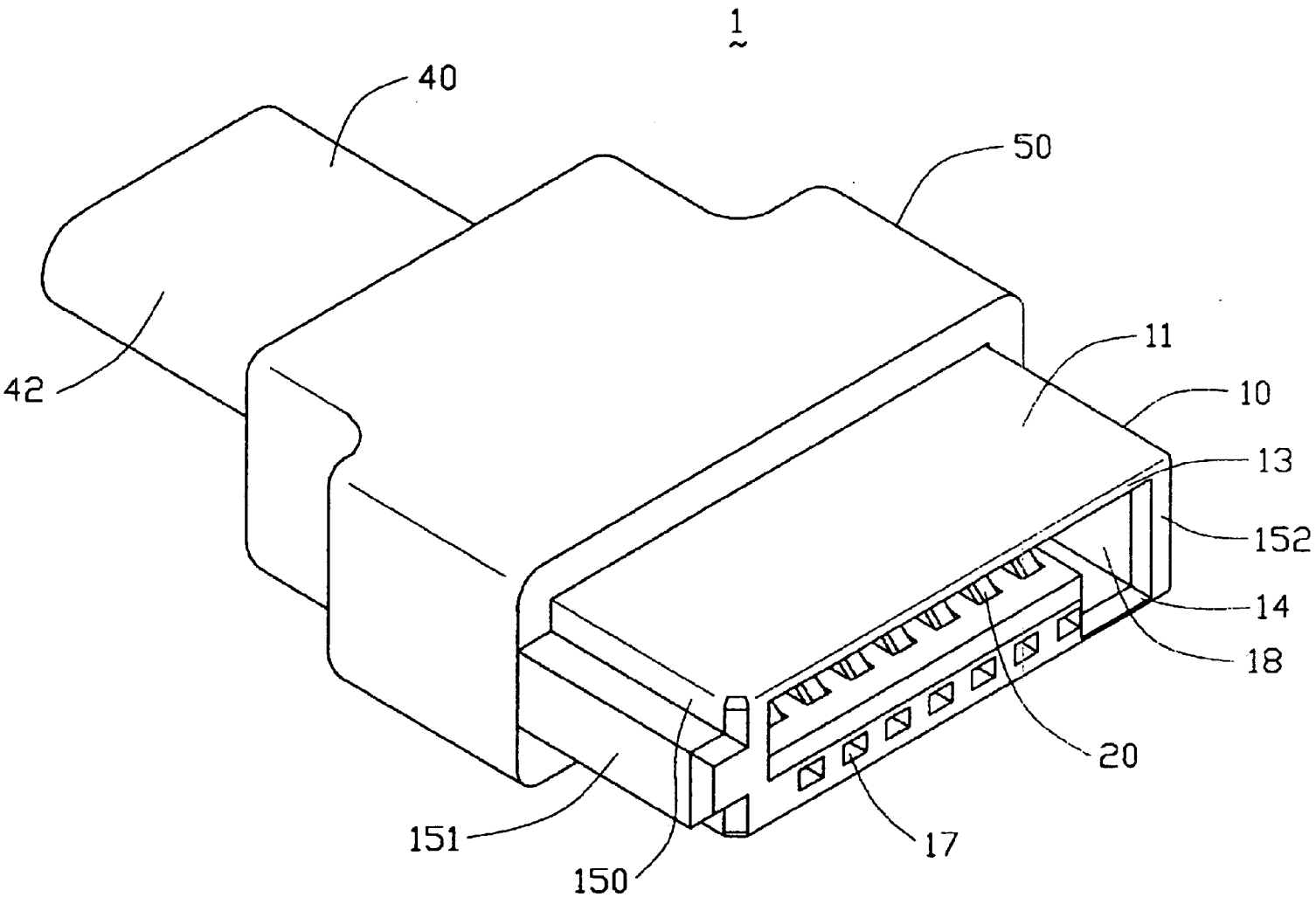
FIG. 1 is an assembled view of a cable end connector assembly in accordance with the present invention.

Referring to FIGS. 1 to 4, a cable end connector assembly 1 in accordance with the present invention comprises a dielectric housing 10, a plurality of contacts 20, a spacer 30, a cable 40, and a cover 50. In the preferred embodiment of the present invention, the cable end connector assembly 1 is in the form of a Serial ATA cable end connector assembly.

The dielectric housing 10 is in the shape of a rectangular block and comprises a front portion 11 and a rear portion 19 extending rearwardly from the front portion 11. The front portion 11 of the housing 10 comprises an upper wall 13, a lower wall 14, and a pair of opposite sidewalls 150, 153 connecting the upper and lower walls 13, 14. The upper and lower walls 13, 14, and the opposite sidewalls 150, 153 together define an L-shaped receiving space 18 in the front portion 11 for receiving a mating portion of a complementary electrical connector therein. A plurality of passageways 17 is defined through the lower wall 14 of the front portion 11 in a front-to-rear direction. A guiding projection 151 protrudes sidewardly from an outer surface of the sidewall 150 for engaging with the complementary electrical connector. The rear portion 19 is formed by an upper wall 192, a lower wall 193, and a pair of sidewalls 194. A pair of protrusions is formed on one sidewall 194 for engaging with the cover 50. A plurality of holes 191 is defined in the upper and lower walls 192, 193, and the opposite sidewalls 194 of the rear portion 19 for receiving the melted plastic material of the cover 50. The protrusions, the guiding projection 151 of the front portion 11, and the sidewall 194 of the rear portion 19 together define a channel 152 for receiving the melted plastic material of the cover 50. A receiving slot 195 is defined by the upper and lower walls 192, 193, and the sidewalls 194 of the rear portion 19 of the housing 10. An outer surface of the upper wall 192 of the rear portion 19 is higher than that of the upper wall 13 of the front portion 11. An outer surface of the lower wall 193 of the rear portion 19 is lower than that of the lower wall 14 of the front portion 11. Thus, the rear portion 19 can provide a retaining force between the housing 10 and the cover 50.

Each contact 20 comprises a retention portion 22, a mating portion 21 extending forwardly from the retention portion 22, and a tail portion 23 extending rearwardly from the retention portion 22. Each retention portion 22 forms a plurality of barbs 221 on a pair of sides thereof.

The spacer 30 is a rectangular board and defines a plurality of through holes 31 corresponding to the tail portions 23 of the contacts 20. An upper edge and a lower edge of the spacer 30 each forms a pair of tubers 32 for engaging with inner surfaces of the receiving slot 195 of the housing 10.

The cable 40 comprises a plurality of conductive cores 41 surrounded by an outer insulating jacket 42.

The cover 50 is preferably comprised of molded plastic or polymer material and comprises an upper wall 51, a lower wall 52, and a pair of opposite lateral walls 55 connecting the upper and lower walls 51, 52. A pair of outstanding portions 53 is formed on opposite inner surfaces of the upper and the lower walls 51, 52, respectively and adjacent to a front face of the cover 50 for preventing the rear portion 19 of the housing 10 from moving along a front-to-rear direction of the housing 10.

Figure 2:
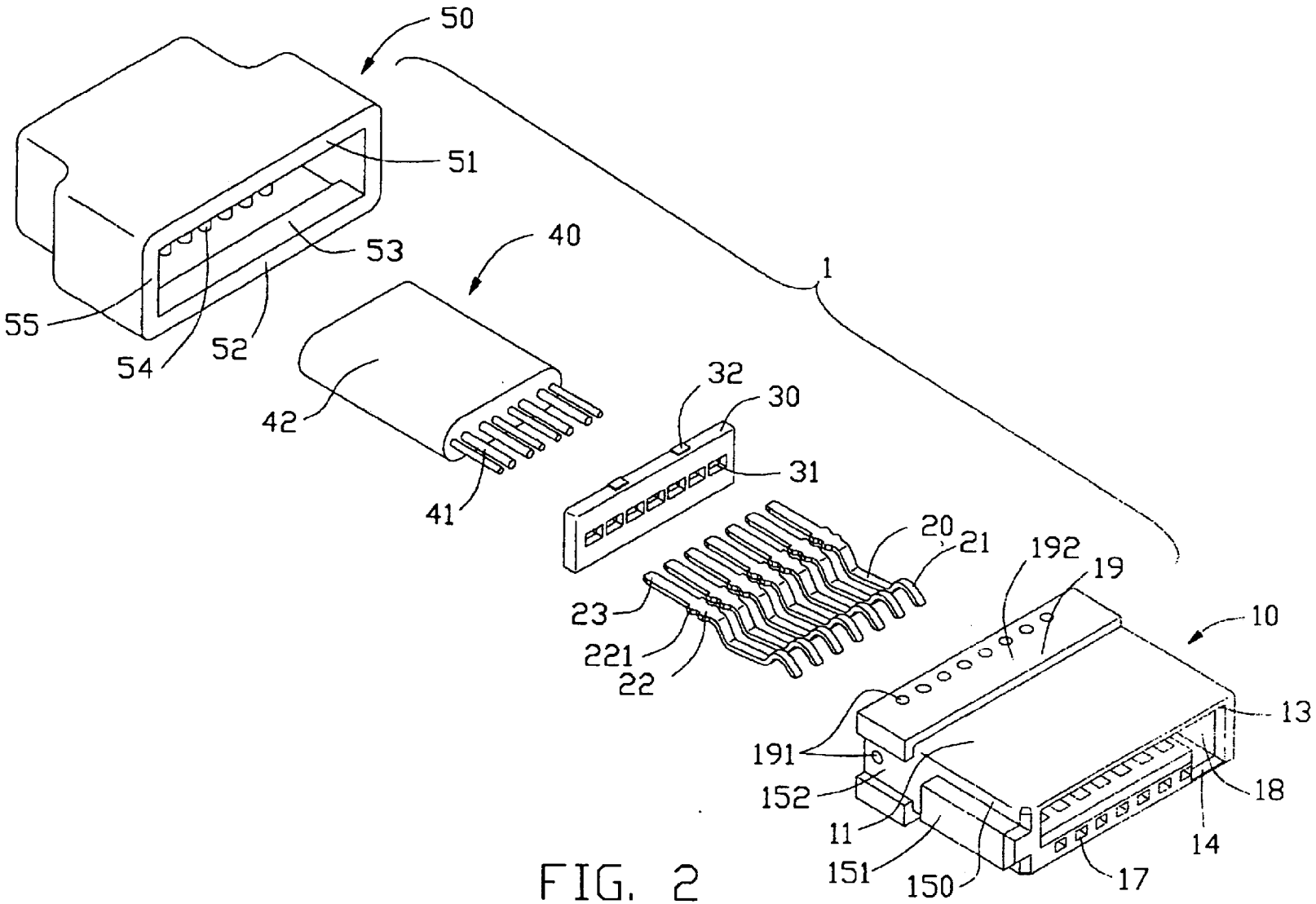
FIG. 2 an exploded, perspective view of the cable end connector assembly shown in FIG. 1.
Figure 3:
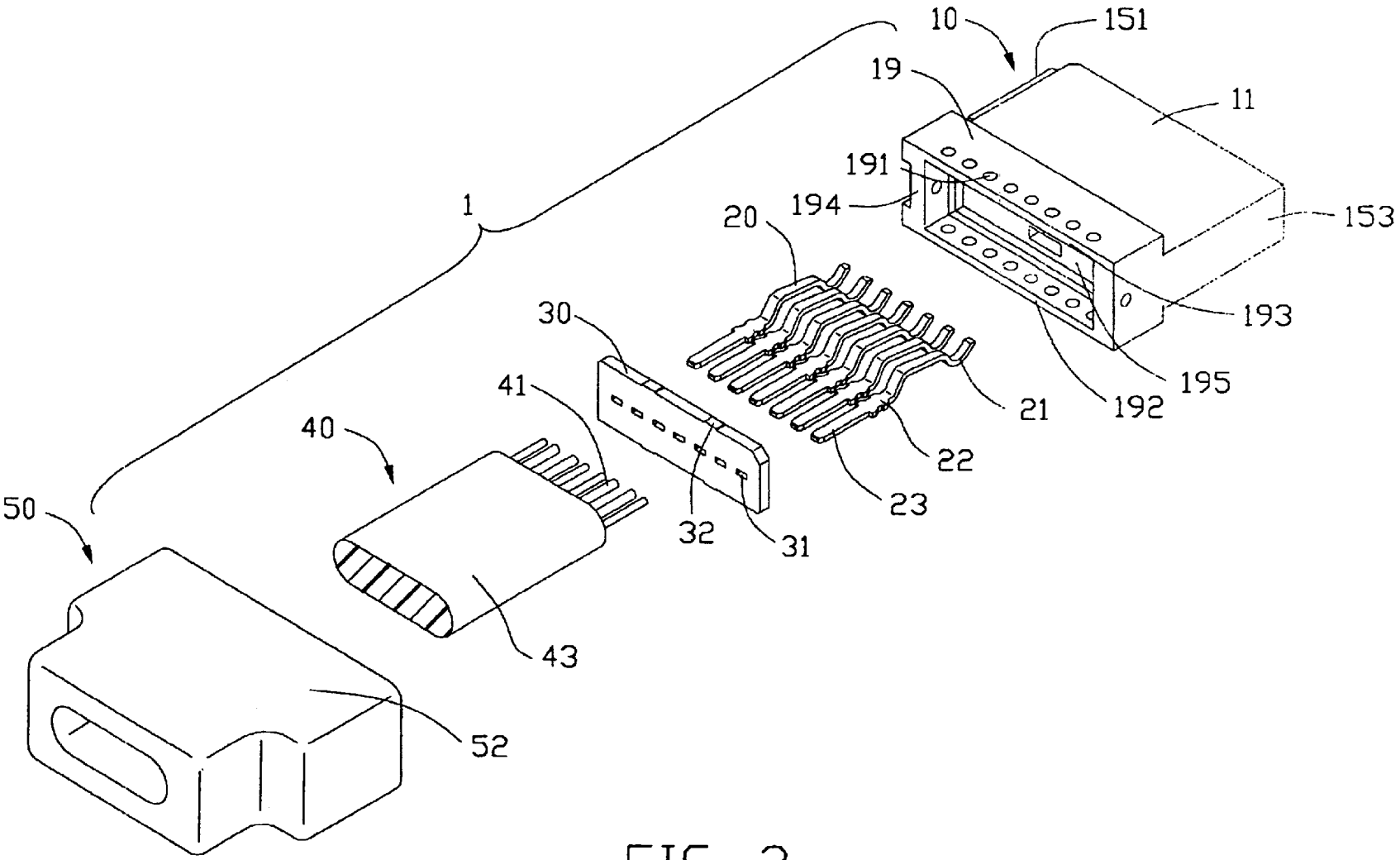
FIG. 3 is a view similar to FIG. 2, but taken from rear and bottom aspects.
Figure 4:
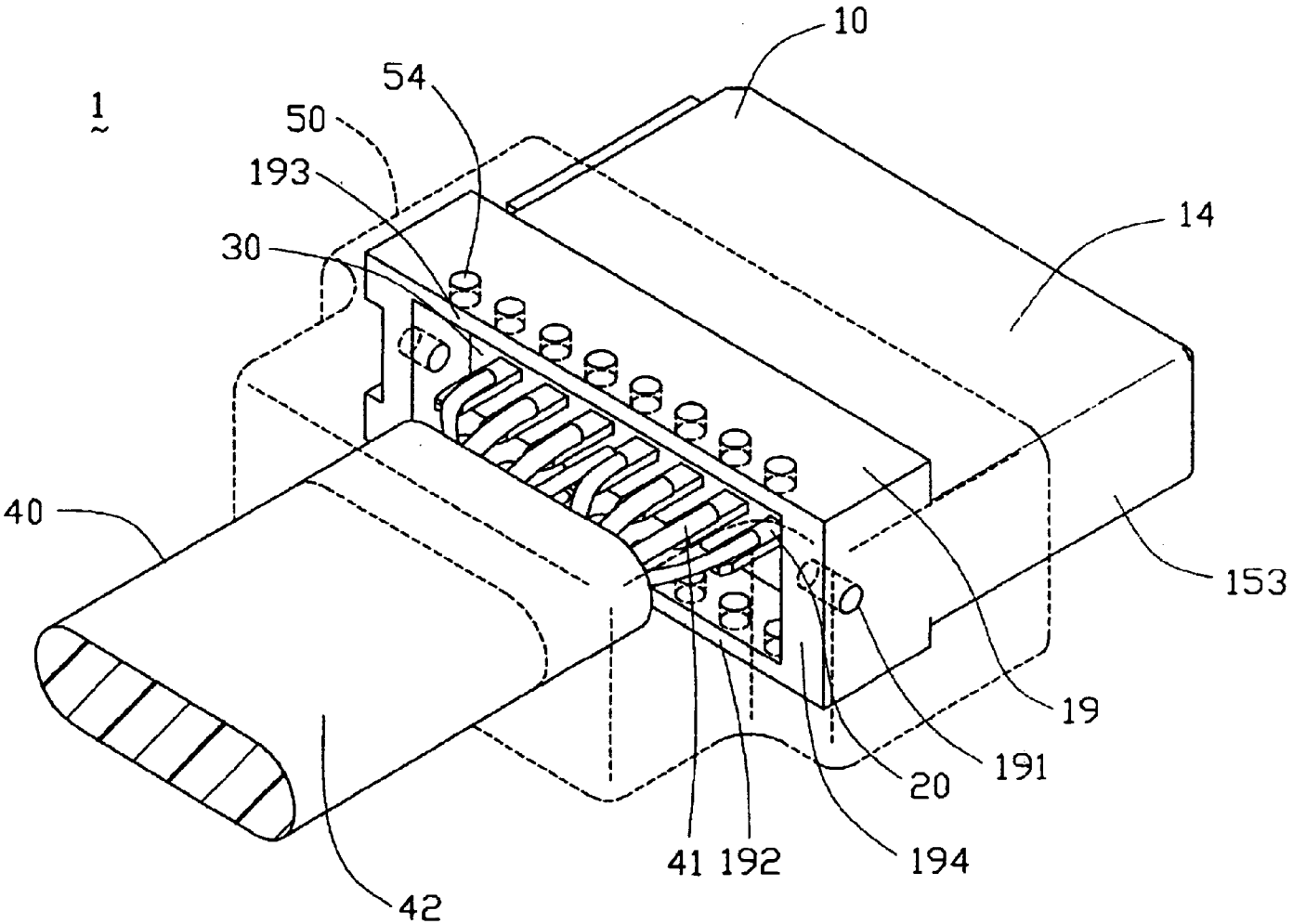
FIG. 4 is an assembled view of FIG. 3, with a cover in a perspective view.
Figure 5:
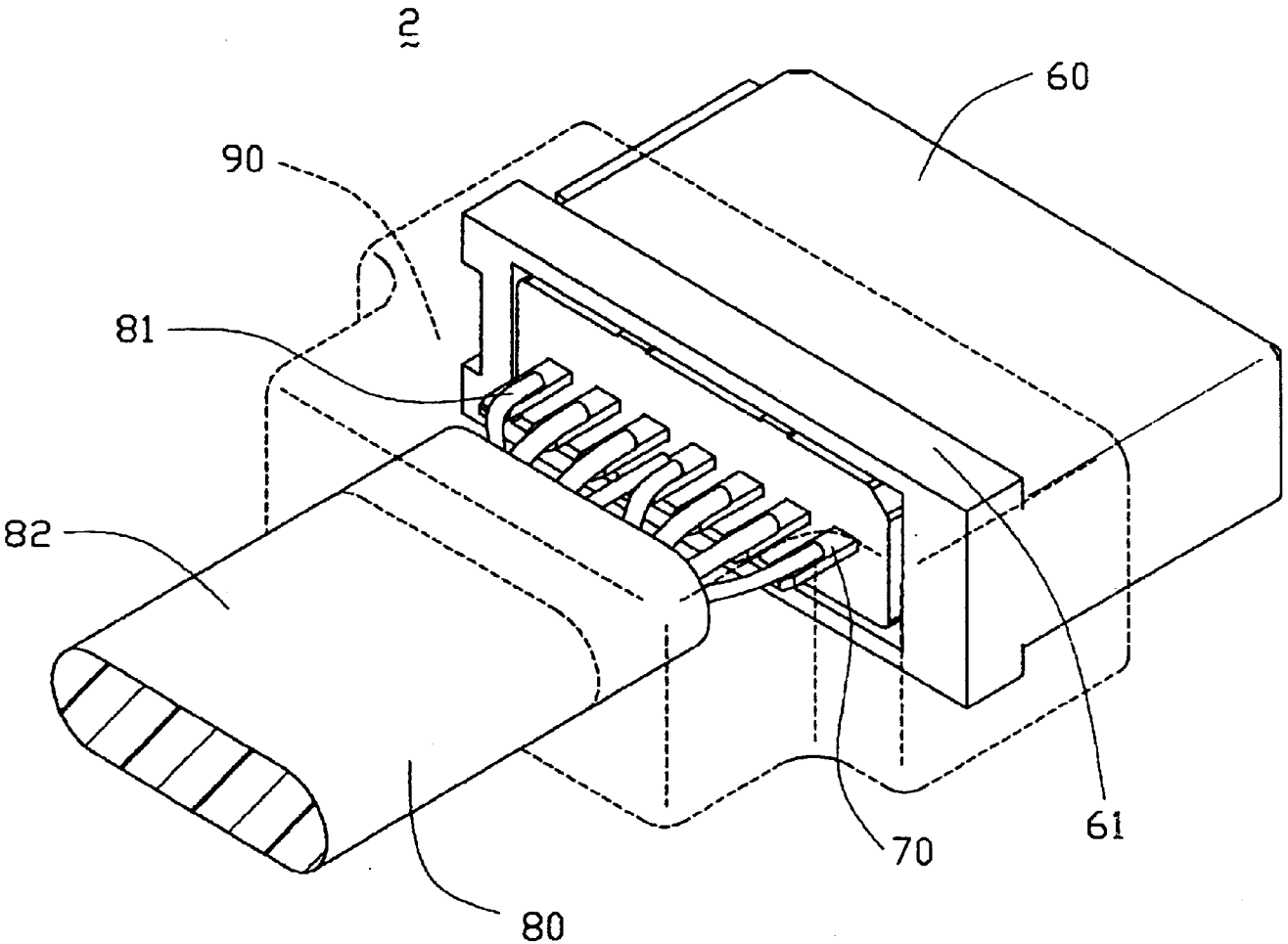
FIG. 5 (PRIOR ART)
FIG. 5 is an assembled view of a conventional cable end connector assembly, with a cover in a perspective view.

In assembly, referring to FIGS. 2 to 4, the contacts 20 are first inserted into the dielectric housing 10 in a rear-to-front direction. The mating portion 21 of each contact 20 protrudes through and is received in corresponding passageway 17, and is partly exposed in the receiving space 18 for electrically connecting the complementary electrical connector. The retention portion 22 of each contact 20 is received in corresponding passageway 17 and the barbs 221 thereof engage with opposite inner surfaces of the passageway 17 for retaining the contacts 20 to the housing 10 fixedly. The tail portion 23 of each contact 20 is exposed in the rear portion 19 of the housing 10 for being soldered with the cable 40. Then, the spacer 30 is pushed and received into the receiving slot 195 with the tubers 32 engaging with the inner surfaces of the receiving slot 195. The tail portions 23 protrude through the through holes 31 of the spacer 30, respectively. The spacer 30 seals the rear portion 19 of the housing 10 and efficiently prevents the melted plastic material of the cover 50 from entering into the housing 10 and influencing the electrical connection between the cable end connector assembly 1 and the complementary electrical connector.

The conductive cores 41 of the cable 40 are then respectively soldered with the tail portions 23 of the contacts 20, thus, the housing 10 electrically connects with the cable 40. The cover 50 is over-molded with the rear portion 19 of the housing 10 and the front end of the cable 40. The rear portions 19 of the housing 10 and the front end of the cable 40 are received in a front portion and a rear portion of the cover 50, respectively. The rear portion of the cover 50 is thinner than the front portion of the cover 50 for being grasped conveniently. The lateral wall 55 of the cover 50 is received in the channel 152 of the housing 10 when in melted state and an outer surface thereof is coplanar with an outer surface of the guiding projection 151. The melted plastic material of the cover 50 flows through the holes 191 defined in the upper and lower walls 192, 193 and the sidewalls 194 of the rear portion 19; thus, a plurality of strengthened projections 54 is formed on inner surfaces of the upper wall 51, the lower wall 52, and the pair of sidewalls 55 of the cover 50 corresponding to the holes 191 defined in the housing 10. These strengthened projections 54 furthest increase the retaining force between the housing 10 and the cover 50, and the housing 10 and the cover 50 engage with each other more reliably. The cover 50 forms a strain relief between the housing 10 and the cable 40. The cover 50 also protects the electrical connection between the contacts 20 and the conductive cores 41 of the cable 40. Therefore, the cable end connector assembly 1 in accordance with the present invention achieves the goal of assuring the reliable engaging connection between the housing 10 and the cover 50.

In alternative embodiments, the through holes 191 can be a plurality of projections formed on the upper and lower walls 192, 193, and the sidewalls 194 of the rear portion 19 of the housing 10. The projections 54 of the cover 50 can be a plurality of holes defined in the inner surfaces of the upper and lower walls 51, 52, and the lateral walls 55. The projections of the housing 10 are respectively received in the holes defined in the cover 50, whereby the reliable engaging connection between the housing 10 and the cover 50 is assured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

It is claimed:

1. A cable end connector assembly adapted for mating with a complementary electrical connector, comprising:

a dielectric housing comprising a front portion and a rear portion extending rearwardly from the front portion, a plurality of passageways defined in the front portion of the housing in a front-to-rear direction, at least one through hole defined in the rear portion of the dielectric housing and extending in a direction perpendicular to said front-to-rear direction;

a plurality of contacts received in the passageways respectively, each contact comprising a mating portion adapted for electrically connecting the complementary connector and a tail portion opposite to the mating portion;

a cable comprising a plurality of conductive cores electrically connecting the tail portions of the contacts, respectively; and a cover over-molded with the rear portion of the housing and a front end of the cable for protecting the electrical connection between the conductive cores and the contacts, at least one projection formed on an inner surface of one wall of the cover and received in the at least one through hole of the dielectric housing for enhancing a retaining force between the cover and the housing in the front-to-rear direction.

2. The cable end connector assembly as claimed in claim 1, wherein said hole is a pair of through holes further defined in the opposite sidewalls of the rear portion of the housing, and the projection is a pair of projections formed on inner surfaces of the lateral walls of the cover, the projections are respectively received in the through holes.

3. The cable end connector assembly as claimed in claim 1, wherein each contact further comprises a retention portion connecting the mating portion and the tail portion, a plurality barbs is formed on a pair of sides of the retention position of each contact and engage with opposite inner surfaces of corresponding passageway.

4. The cable end connector assembly as claimed in claim 1, wherein the mating portion of each contact is received in the passageway and the tail portion is exposed in the rear portion of the housing.

5. The cable end connector assembly as claimed in claim 1, wherein a guiding projection protrudes sidewardly from an outer surface of one sidewall of the front portion of the housing adapted for engaging with the complementary electrical connector.

6. The cable end connector assembly as claimed in claim 1, further comprising a spacer received in the rear portion of the housing.

7. The cable end connector assembly as claimed in claim 6, wherein the housing defines a receiving slot in the rear portion thereof by the upper wall, the lower wall and the sidewalls of the rear portion, and the spacer is received in the receiving slot and seals the rear portion of the housing for preventing the melted plastic material of the cover from entering into the housing when the plastic material of the cover in the melted state.

8. The cable end connector assembly as claimed in claim 7, wherein the spacer defines a plurality of through holes therein, the tail portions of the contacts protrude through the through holes and are soldered with the conductive cores, respectively.

9. The cable end connector assembly as claimed in claim 1, wherein the rear portion of the housing comprises an upper wall, a lower wall, and a pair of opposite sidewalls, the cover comprises an upper wall, a lower wall, and a pair of lateral walls, the through hole is a plurality of through holes defined in the upper and the lower walls of the rear portion, and the projection is a plurality of projections formed on inner surfaces of the upper and the lower walls of the cover, the projections are respectively received in the holes.

10. The cable end connector assembly as claimed in claim 9, wherein the front portion of the housing is formed by an upper wall, a lower wall, and a pair of sidewalls, and the front portion defines an L-shaped receiving space adapted for receiving a mating portion of the complementary electrical connector therein.

11. The cable end connector assembly as claimed in claim 10, wherein the passageways are defined through the lower wall of the front portion of the housing in the front-to-rear direction.

12. The cable end connector assembly as claimed in claim 10, wherein an outer surface of the upper wall of the rear portion is higher than that of the upper wall of the front portion, an outer surface of the lower wall of the rear portion is lower than that of the lower wall of the front portion.

13. The cable end connector assembly as claimed in claim 12, wherein a pair of outstanding portions is formed on the inner surfaces of the upper and the lower walls of the cover and adjacent to a front face of the cover and engage with the upper and lower walls of the rear portion of the housing for preventing the rear portion from moving along a front-to-rear direction of the housing.

14. A cable end connector assembly comprising:

a housing assembly for receiving a complementary connector therein, including a dielectric housing and a spacer housing attached to the housing, said dielectric housing defining a cavity extending in a horizontal plane;

a plurality of contacts retained by at least one of said dielectric housing and said spacer housing, each of said contacts including a mating portion extending forwardly into the cavity and a solder portion extending rearwardly out the spacer housing;

a cable including a plurality of conductive cores soldered upon the corresponding solder portions of the contacts, respectively;

a cover over-molded with a rear portion of the housing assembly and a front portion of the cable; and a plurality of through holes being formed in the rear portion of said housing assembly, and material of said cover extending in a direction perpendicular to said horizontal plane and into said plurality of through holes and intercepting the rear portion of the housing assembly for efficiently resisting relative horizontal movement between the cover and the housing assembly along said plane; wherein said housing assembly defines a receiving slot in the rear portion under a condition that said receiving slot is filled with the material of the cover and communicates with said through holes.

* * * * *